US012151287B2

(12) United States Patent
Yoshida et al.

(10) Patent No.: US 12,151,287 B2
(45) Date of Patent: Nov. 26, 2024

(54) METHOD FOR MANUFACTURING SINTERED COMPONENT AND SINTERED COMPONENT

(71) Applicant: SUMITOMO ELECTRIC SINTERED ALLOY, LTD., Okayama (JP)

(72) Inventors: Kentaro Yoshida, Okayama (JP); Shoichi Takada, Okayama (JP); Hirofumi Kiguchi, Okayama (JP)

(73) Assignee: SUMITOMO ELECTRIC SINTERED ALLOY, LTD., Okayama (JP)

( * ) Notice: Subject to any disclaimer, the term of this patent is extended or adjusted under 35 U.S.C. 154(b) by 0 days.

(21) Appl. No.: 17/929,328

(22) Filed: Sep. 2, 2022

(65) Prior Publication Data

US 2022/0410260 A1 Dec. 29, 2022

Related U.S. Application Data

(62) Division of application No. 16/632,688, filed as application No. PCT/JP2018/028224 on Jul. 27, 2018, now Pat. No. 11,465,206.

(30) Foreign Application Priority Data

Aug. 4, 2017 (JP) ..... 2017-152049

(51) Int. Cl.
*B22F 3/16* (2006.01)
*B22F 3/12* (2006.01)
(Continued)

(52) U.S. Cl.
CPC ..... *B22F 3/162* (2013.01); *B22F 3/24* (2013.01); *B22F 5/009* (2013.01);
(Continued)

(58) Field of Classification Search
CPC .. B22F 3/162; B22F 3/24; B22F 5/009; B22F 5/106; B22F 3/12; B22F 2003/245;
(Continued)

(56) References Cited

U.S. PATENT DOCUMENTS 3,143,079 A * 8/1964 Carner ..... F04C 14/223 418/24
4,532,788 A 8/1985 Venables, III
(Continued)

FOREIGN PATENT DOCUMENTS

DE 102014200730 A1 * 7/2015 ..... F01C 21/08
GB 2396624 A * 6/2004 ..... B22F 3/24
(Continued)

OTHER PUBLICATIONS

English Machine Translation of JP2016-150500A via USPTO Fit Datebase on Sep. 13, 2023 (Year: 2015).*
(Continued)

*Primary Examiner* — Mary A Davis
(74) *Attorney, Agent, or Firm* — IPUSA, PLLC

(57) ABSTRACT

A method for manufacturing a sintered component is provided. The method includes a step of making a green compact having a relative density of at least 88%. The green compact is made by compression-molding a base powder containing a metal powder into a metallic die. The method includes a step of machining a groove part in the green compact. The groove part is processed in the green compact by a cutting tool and has a groove width of 1.0 mm or less. A step of sintering the green compact in which the groove part is machined occurs after the step of machining the groove part.

5 Claims, 3 Drawing Sheets

(51) Int. Cl.

| | |
|---|---|
| ***B22F 3/24*** | (2006.01) |
| ***B22F 5/00*** | (2006.01) |
| ***F01C 21/08*** | (2006.01) |
| ***F04C 18/04*** | (2006.01) |
| *B22F 5/10* | (2006.01) |

(52) U.S. Cl.
CPC ..... *F01C 21/0809* (2013.01); *B22F 3/12* (2013.01); *B22F 2003/245* (2013.01); *B22F 5/106* (2013.01); *B22F 2301/052* (2013.01); *B22F 2301/10* (2013.01); *F04C 18/04* (2013.01); *F04C 2240/20* (2013.01)

(58) Field of Classification Search
CPC ..... B22F 2301/052; B22F 2301/10; F01C 21/0809; F04C 18/04; F04C 2240/20
See application file for complete search history.

(56) References Cited

U.S. PATENT DOCUMENTS

| | | | | |
|---|---|---|---|---|
| 6,688,154 | B2 * | 2/2004 | Anazawa | B21K 3/00 72/352 |
| 8,615,867 | B2 * | 12/2013 | Giunchi | H10N 60/0772 505/917 |
| 8,870,557 | B2 * | 10/2014 | Chan | F01C 20/06 418/268 |
| 8,992,659 | B2 | 3/2015 | Larsson et al. | |
| 8,998,594 | B2 * | 4/2015 | Pawellek | F04C 2/3442 418/16 |
| 9,309,766 | B2 * | 4/2016 | Feustel | F01C 21/0809 |
| 10,960,633 | B2 | 3/2021 | Onodera et al. | |
| 11,465,206 | B2 * | 10/2022 | Yoshida | C22C 1/0416 |
| 2004/0182200 | A1 | 9/2004 | Takiguchi et al. | |
| 2007/0081915 | A1 | 4/2007 | Trasorras et al. | |
| 2007/0172380 | A1 * | 7/2007 | Tatsumoto | H01F 41/0246 75/255 |
| 2010/0116088 | A1 * | 5/2010 | Sato | C22C 33/0264 75/243 |
| 2018/0163543 | A1 * | 6/2018 | Morton | F04C 2/3446 |

FOREIGN PATENT DOCUMENTS

| | | | | |
|---|---|---|---|---|
| JP | H05-279709 | | 10/1993 | |
| JP | 2009-257276 | | 11/2009 | |
| JP | 2010-150567 | | 7/2010 | |
| JP | 2010150567 | A * | 7/2010 | F01C 21/08 |
| JP | 2015-086408 | | 5/2015 | |
| JP | 2015178988 | A * | 10/2015 | G01N 27/407 |
| JP | 2015-203128 | | 11/2015 | |
| JP | 2016150500 | A * | 8/2016 | G01N 27/407 |

OTHER PUBLICATIONS

English Machine Translation of JP2015-178988A via USPTO Fit Datebase on Sep. 13, 2023 (Year: 2015).*
English Machine Translation of DE102014200730A1 via USPTO Fit Datebase on Sep. 12, 2023 (Year: 2015).*
English Machine Translation of JP20100150567A via USPTO Fit Datebase on Sep. 13, 2023 (Year: 2010).*
A. Salak et al: "Machinability of Powder Metallurgy Steels" In: "Machinability of Powder Metallurgy Steels", Dec. 29, 2005 (Dec. 29, 2005), Cambridge International Science Publishing, XP055680606, ISBN: 978-1-898326-82-3 pp. 1-536, p. 283; table 7.6 a/b.
JP-2010150567-A English language translation (Year: 2010).

* cited by examiner

METHOD FOR MANUFACTURING SINTERED COMPONENT AND SINTERED COMPONENT

CROSS-REFERENCE TO RELATED APPLICATIONS

This application is a divisional of U.S. patent application Ser. No. 16/632,688, filed on Jan. 21, 2020, which is a national stage application of PCT/JP2018/028224, filed on Jul. 27, 2018, which is based on and claims priority to Japanese Patent Application No. 2017-152049, filed on Aug. 4, 2017, and the entire contents of these applications are incorporated herein by reference.

TECHNICAL FIELD

The present invention relates to a method for manufacturing a sintered component and to the sintered component.

BACKGROUND ART

Patent Document 1 discloses an invention relating to a mold for press forming in which a recess (groove part) is molded on the outer periphery of a sintered mold (compact body) of a rotor for a vane pump. Patent Document 1 discloses that a plurality of flat cores are provided to protrude inside the holes of the dies and form recesses by each of the cores.

BACKGROUND ART DOCUMENT

Patent Document

Patent Document 1: Japanese Laid-Open Patent Application No. 5-279709

SUMMARY OF THE INVENTION

Means for Solving the Problem

The method for manufacturing a sintered component includes a step of making a green compact having a relative density of at least 88% by compression-molding a base powder containing a metal powder into a metallic die, a step of machining a groove part having a groove width of 1.0 mm or less in the green compact by processing groove with a cutting tool, and a step of sintering the green compact in which the groove part is formed after the step of forming the groove part.

For the sintered component of the present disclosure, a relative density is 88% or greater, and the groove part has a groove width of 1.0 mm or less.

MODE OF CARRYING OUT THE INVENTION

Figure 1:
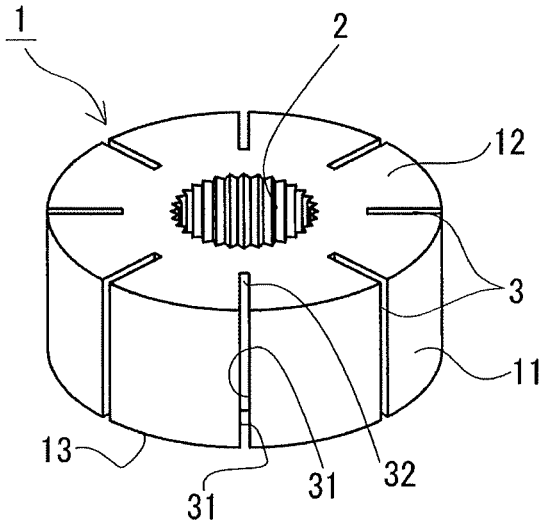
FIG. 1 is a schematic perspective view illustrating an example of a sintered component according to an embodiment.

A sintered component made by molding and sintering metal powders such as iron powder is used for various parts such as an automobile and industrial machinery. Generally, a sintered component is manufactured by compressing and molding base powder containing metal powder into a metallic die to form a green compact, which is then sintered. The sintered components may be in a shape having a groove part. For example, one of these sintered components is a rotor used for, for example, a vane pump. The rotor for the vane pump has a plurality of groove parts radially formed on the outer peripheral surface of the rotor, and the vanes are slidably inserted into each groove part. Each vane protrudes radially from each groove part as the rotor rotates, so that a tip end of the vane contacts during sliding on an inner peripheral surface of the cam ring, and the side surface part of the vane contacts during sliding on a plate material, a pump case, or the like.

Conventionally, when the sintered component having a groove part, such as a rotor for a vane pump, is manufactured, the groove part is molded into the green compact by molding. Patent Document 1 discloses an invention related to a mold for press forming in which a recess (a groove part) is molded on the outer periphery of a sintered mold (compact body) of a rotor for a vane pump. Patent Document 1 discloses that a plurality of plates are formed to protrude a core like a flat plate inside die holes provided in the mold, and a recess is formed by each core.

Problems to be Solved by this Disclosure

In the sintered component having a groove part, it is required to increase the density of the sintered component and to narrow the groove part. By densifying the sintered component, rigidity can be improved, and durability can be improved by suppressing chipping and breakage of the sintered component. For example, in the case of a rotor for a vane pump, the groove width of the groove part into which the vane is inserted can be narrowed, thereby reducing the thickness of the vane used. Thinning of the vane reduces the contact area between the tip of the vane and the inner circumferential surface of the cam ring, and between the side surface of the vane and the plate material or the pump case, thereby reducing the sliding resistance and reducing the pump loss. In addition, if the groove parts are polished, the replacement during processing can be reduced. However, a conventional manufacturing method of forming a groove part in a green compact by molding a die using a mold with a core on the die has difficulty achieving both a high density of sintered component and a narrowing of the groove part.

In order to densify sintered component, it is necessary to densify the green compact prior to sintering, which includes increasing the surface pressure during compression molding of the base powder. When the surface pressure is increased, the pressure acting on the base powder increases, and the pressure distribution of the base powder tends to increase on both sides of the core that forms the groove part. This differential pressure distribution disrupts the pressure balance on both sides of the core and increases the bending stress acting on the core. The larger the height (axial length)

of the green compact to be molded, the more likely the difference in pressure distribution and the greater the bending stress acting on the core.

On the other hand, narrowing of the groove parts requires thinning of the core to form the groove parts. However, when the core is thinned, the stiffness of the core decreases, and when the surface pressure is increased, excessive bending stress is applied to the core, causing deformation and breakage of the core during compression molding.

Accordingly, conventional manufacturing methods require that the core thickness be set such that the core does not deform, even if the surface pressure is increased and the green compact is densified, limiting the groove width of the groove part due to core limitations. In the case of a sintered component having a groove part obtained by conventional molding, the relative density of the sintered component was about 85 to 86%, and the groove width of the groove part was about 2.0 mm. Accordingly, the present disclosure is intended to provide a method of manufacturing a sintered component capable of forming a groove part having a narrow groove width while densifying a sintered component. Another object is to provide a sintered component having a dense but narrow groove width.

Effect of the Disclosure

The method of manufacturing the sintered component of the present disclosure is capable of forming a groove part having a narrow width while making the sintered component denser. The sintered components of the present disclosure have a dense, yet narrow groove width.

DESCRIPTION OF EMBODIMENTS OF THE PRESENT INVENTION

Embodiments of the present invention will be described.

(1) A method for manufacturing a sintered component according to an embodiment of the present invention includes a step of forming the green compact with a relative density of 88% or greater by compressing base powder containing a metal powder into a mold, a step of forming a groove part having a groove width of 1.0 mm or less in the green compact by grooving with a cutting tool, and, after the step of forming the groove part, a step of sintering the green compact having the groove part formed therein.

According to the method for manufacturing the sintered component described above, the groove part is processed into the green compact before sintering in a processing process that is a post process instead of forming the groove part in the green compact by a molding step as in the past. Therefore, in the molding step, there is no constraint on the core for forming the groove part, and the green compact can be densified by increasing the surface pressure, and the green compact with a high density of 88% or greater can be easily manufactured. If the relative density of the green compact before sintering is 88% or greater, the relative density of the sintered component after sintering is 88% or greater. Here, "relative density" means the actual density relative to the true density (percentage of [measured density/true density]). The true density is the density of the metal powder constituting the green compact (sintered component). In a case of iron powder, the true density is 7.874 g/cm$^3$, with a relative density of 88% or greater being 6.93 g/cm$^3$ or greater.

In addition, in the processing process, because the groove part is processed on the green compact before sintering, a narrow groove part having a groove width of 1.0 mm or smaller can be easily formed. In the green compact, the base powder is only solidified by molding, and the particles of the metal powder are mechanically closely adhered to each other. Therefore, the green compact is not strongly bonded as it is after sintering. For this reason, when a cutting tool such as a milling cutter is used for the pre-sintering green compact, the bonding between the particles of the metal powder is weaker, the cutting is easier, and the productivity is better than when a cutting tool is used for a post-sintering green compact. On the other hand, when the groove part is processed after sintering, it is difficult to cut because the particles of the metal powder are firmly bonded together by sintering, resulting in a decrease in productivity. The groove width of the groove part to be formed can be set by the cutting tool used.

Accordingly, the method of manufacturing the sintered component can form a groove part with a narrow groove width while the sintered component can be densified.

(2) One aspect of the method of manufacturing the sintered component is that the cutting tool is a milling cutter having a cutting blade at its outer periphery and has substantially no escape face on the side of the cutting blade.

A suitable groove part cutting tool can be used to form the groove part, for example, a milling cutter having a cutting blade around the outer circumference can be suitably used. In particular, the surface roughness of the internal side surface of the groove part can be reduced when the green compact is grooved with a milling that has substantially no escape face on a side surface of the cutting blade. Here, "substantially no escape face is present on the side of the cutting blade" means that the escape gradient on the side surface is 0° or greater and 0.15° or less. The reason for the reduced surface roughness of the internal side surface of the groove part is thought to be as follows.

When the cutting tool is used to process the green compact, the particles of the metal powder are scraped off with a cutting blade to form a groove part, because the bond between the particles of the metal powder is weak. When a groove part is formed by the progress of the cutting blade, particles may occasionally come off from the internal side surface of the groove part facing the side surface of the cutting blade, resulting in the formation of irregularities on the internal side surface by the particles. If there is substantially no escape face on the side surface of the cutting blade as described above, the side of the surface of the cutting blade will push the particles in the internal side surface of the cutting blade because there is no escape space between the side of the cutting blade and the side of the groove part and there is no escape space for particles falling from the side of the groove part. Therefore, it is possible to suppress the formation of the irregularities and irregularities by the particles on the internal side surface of the groove part, thereby smoothing the internal side surface and reducing the surface roughness. Specifically, the surface roughness Ra (arithmetic average roughness) of the internal side surface of the groove part may be 5 μm or less when the side surface of the cutting blade does not have an escape face. On the other hand, if there is the escape face on the side surface of the cutting blade, a gap is formed between the side surface of the cutting blade and the internal side surface of the groove part at the position of the escape face, allowing for the escape of particles falling out from the internal side surface of the groove part, and the dropping of particles from the internal side surface may occur. Therefore, the internal side surface of the groove part forms the irregularities caused by the particles, and the surface roughness of the internal side surface increases, for example, the surface roughness Ra becomes not less than 8 μm.

(3) As one aspect of the method for manufacturing the sintered component, in the step of forming the groove part, groove machining is performed by holding the green compact in a jig, the jig having a binding face that is pressed against the end face of the green compact on which the cutting tool is removed.

Holding the green compact in the jig and performing the groove machining facilitates the machining operation and stabilizes the machining accuracy. For example, when the groove part is formed from one axial end face of the green compact to the other axial end face, because the bond between particles of the metal powder is weak in the green compact as described above, the opening blade of the groove part is easily chipped at the end face of the green compact on which the cutting tool is removed. Because the jig has a restraining surface as described above, groove machining is performed while the restraining surface of the jig is pressed against the end surface of the cutting tool on the side from which the cutting tool is removed. Therefore, it is possible to effectively prevent a chip from occurring on the end surface of the cutting tool on the side from being removed.

(4) One aspect of the method of manufacturing the sintered component is that the fixture has a positioning mechanism for positioning the center of the green compact.

The positioning mechanism as described above improves the machining accuracy of the groove part with the cutting tool by positioning the axial center of the green compact relative to the jig.

(5) In one embodiment of the method of manufacturing the sintered component, the cutting tool is a milling cutter having a cutting blade and a side surface at an outer periphery, and the angle of the side surface relative to the cutting blade is not more than 0.15 degrees. In the machining step, the groove processing is performed by holding the green compact in a jig. The jig has a constraining surface that is pressed against the end surface of the green compact on which the cutting tool is drawn out. It is contemplated that the jig has a positioning mechanism to position the center of the green compact axis.

The method of manufacturing sintered component in the above manner can form groove parts having narrow groove width while making the sintered component denser.

(6) In the sintered component according to embodiments of the present invention, the relative density is 88% or greater, the groove part has a groove width of 1.0 mm or less, and the sintered component has a dense, yet narrow groove width.

Because the relative density of sintered component is 88% or greater and the density is high, it is highly rigid and is excellent in the durability. The groove width of the groove part is 1.0 mm or less, and the groove width of the groove part is small. Examples of the sintered component having the groove part include a rotor for a vane pump and a heat sink. For example, in the case of the rotor for the vane pump, the groove width of the groove part into which the vane is inserted can be narrowed to reduce the thickness of the vane used. This reduces the sliding resistance between the tip of the vane, the inner peripheral surface of the cam ring, and the side surface of the vane, the plate material, the pump case, and the like, thereby reducing the pumps loss. In the case of a heat sink, for example, the number of groove parts per a unit area can be increased because the groove width of the groove part is small. Accordingly, by increasing the surface area of the heat sink and increasing the heat radiation area, heat radiation performance of the heat sink can be improved.

(7) As an embodiment of the sintered component, the surface roughness of the internal side surface of the groove part section is 5 μm or less at the arithmetic average roughness Ra.

The internal side surface roughness Ra (arithmetic average roughness) of the internal side surface of the groove part is 5 μm or less, and the internal side surface is smooth. Because the surface roughness of the internal side surface of the groove part is small, for example, in the case of a rotor for a vane pump, the sliding resistance of the vane inserted into the groove part is reduced, and the vane is easily slidable. Here, "arithmetic average roughness Ra" is the value measured in accordance with JIS B 0601-2001.

(8) One aspect of the sintered component is that the axial length of the sintered component is 6 mm or greater.

The length (height) of the sintered component in the axial direction is 6 mm or greater, which expands the range of use of sintered component.

In the case of a rotor for a vane pump, because the axial length is 6 mm or greater, it is possible to increase the pump capacity and reduce the rotor diameter, thereby downsizing the pump.

(9) One aspect of the sintered component is that the sintered component is a rotor for a vane pump.

The sintered component according to the above embodiment has a high density but a narrow groove width, and thus can be suitably used in, for example, a rotor for a vane pump. The rotor for vane pumps made of sintered component of the above embodiment has high stiffness and durability, and because the groove width of the groove part is narrow, the vane inserted into the groove part can be thinned down to reduce the pump loss caused by the sliding contact resistance between the vane and the cam ring, as well as between the vane and the plate material and the pump case. In addition, if the groove parts are polished, the replacement during processing can be reduced.

(10) In one embodiment of the sintered component, the sintered component includes a first surface having a cylindrical shape in which the groove part is formed, a second surface connected to the first surface and a third surface facing the second surface. The groove part communicates with the second surface to the third surface, and the groove part has a bottom surface and two internal side surfaces. The angle of the internal side surface to a plane perpendicular to the bottom surface passing through a crossing line between the bottom surface and the internal side surface is not more than 0.15 degrees. The groove width of the aforementioned groove part is not less than 0.3 mm and not more than 1.0 mm. The surface roughness of the internal side surface is 5 μm or less by the arithmetic average roughness Ra. The axial length of the sintered component is 6 mm or greater. The depth of the groove part is 2 mm or greater.

The sintered component according to the above embodiment has a high density but a narrow groove width.

DETAILED EXPLANATION OF EMBODIMENT OF THE PRESENT INVENTION

A method for manufacturing a sintered component and an example of the sintered component according to an embodiment of the present invention will be described below with reference to the drawings. The same symbol in the figure indicates the same name. The present invention is not limited to these examples and is intended to include all modifications within the meaning and scope of the claims and equivalents thereof.

<Manufacturing Method of Sintered Component>

A method of manufacturing the sintered component according to the embodiment is a method of manufacturing a sintered component having a groove part that includes the following steps.

1. Molding step: Base powder containing metal powder is compressed and molded by a metallic die to form the green compact with a relative density of 88% or greater.
2. Machining step: Green compact is grooved with a cutting tool to form a groove part with a groove width of 1.0 mm or less.
3. Sintering step: After the process, the green compact is sintered. Each process will be described in detail below.

Hereinafter, an example will be described in which a sintered component 1 is manufactured as illustrated in FIG. 1. The sintered component 1 illustrated in FIG. 1 is a rotor for a vane pump and is a cylindrical shape in which a shaft hole 2 is formed in the axial center. The sintered component 1 has a groove part 3 that communicates with one end surface along the axial direction to the other end surface. In this example, a plurality of groove parts 3 are radially disposed on the outer peripheral surface, and a plate-like vane (not illustrated) is slidably inserted into each groove part 3.

(Molding Step)

<Metal Powder>

The metal powder used as the base powder is the main material forming the sintered component, and the powder of various metals includes, for example, an iron alloy composed mainly of iron or iron (an iron-based material), an aluminum alloy composed mainly of aluminum or aluminum (an aluminum-based material), and a copper alloy composed mainly of copper or copper (a copper-based material). In the case of rotor for the vane pumps, pure iron powder or iron alloy powder is typically used. Herein, the term "principal component" means that the constituent contains more than 50% by mass of the element, preferably not less than 80% by mass, and not less than 88% by mass. The iron alloy includes at least one alloying element selected from Cu, Ni, Sn, Cr, Mo, and C. The alloying element contributes to the improved mechanical properties of sintered component of an iron-based material. Among the alloying elements, the content of Cu, Ni, Sn, Cr, and Mo is 0.5 mass % or greater and 6.0 mass % or less by mass in total, and further 1.0% or greater and 3.0% or less by mass. The content of C shall be 0.2% to 2.0% by mass, and further 0.4% to 1.0% by mass or less. In addition, iron powder may be used as the metal powder, and a powder of the alloying element (alloying powder) may be added to the powder. In this case, the constituent of the metal powder is iron at the stage of the base powder, but the iron is alloyed by reacting with the alloying element by sintering in the subsequent process. The content of the metal powder (including the alloying powder) in the base powder is, for example, 90% by mass or greater, and 95% by mass or greater. For example, the metal powder produced by the water atomization method, the gas atomization method, the carbonyl method, the reduction method, or the like can be used.

For example, the average particle size of the metal powder may be 20 μm or greater, and further 50 μm or greater and 150 μm or less. By setting the average particle size of the metal powder to within the above range, it can be easily handled and easily compressed. Furthermore, by setting the average particle size of the metal powder to 20 μm or greater, it is easy to secure the flowability of the base powder. By setting the average particle size of the metal powder to 150 μm or less, it is easy to obtain sintered component of dense tissue. The average particle size of the metal powder is defined as the average particle size of the particles constituting the metal powder and is defined as the particle size (D50) in which the cumulative volume of the particle size distribution measured by a laser diffraction particle size distribution measuring device is 50%. In this example, an iron powder is used as the metal powder, and its average particle size is 100 μm.

In the base powder, an internal lubricant may be added in order to suppress the seizure of the metal powder on the mold or to improve the formability of the green compact. Examples of internal lubricants include fatty acid metal salts such as zinc stearate and lithium stearate, and fatty acid amides such as amide stearate and amide ethylene bistearate. The amount of the internal lubricant to be added is, for example, not less than 0.1% by mass but not more than 1.0% by mass, not more than 0.5% by mass. By reducing the amount of internal lubricant added, the ratio of the metal powder contained in the base powder can be increased, and it is easy to form the green compact with a relative density of 88% or greater. The amount of internal lubricant to be added is the ratio of the lubricant to the powder of the raw material assuming that 100% by mass of the whole powder of the raw material is free of internal lubricant.

In addition, an organic binder may be added as a molding aid to the base powder. Examples of organic binders include polyethylene, polypropylene, polyolefin, polymethylmethacrylate, polystyrene, polyvinyl chloride, polyvinylidene chloride, polyamide, polyester, polyether, polyvinyl alcohol, vinyl acetate, paraffin, various waxes, and the like. The organic binder may or may not be added if necessary.

<Compression Molding>

Figure 2:
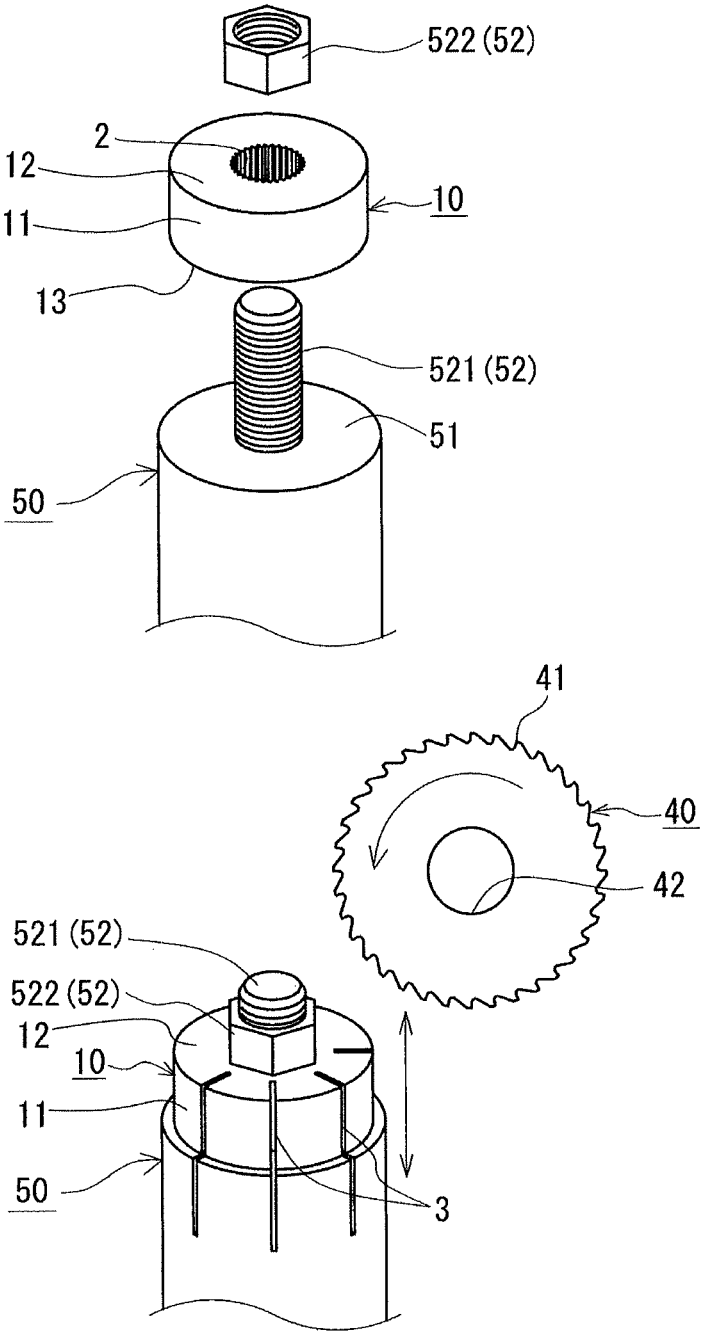
FIG. 2 schematically illustrates a machining step in a method of manufacturing the sintered component according to the embodiment.

In compression molding, for example, a mold including a die with a mold hole formed thereon and an upper and lower punch positioned opposite the top and bottom of the die and inserted into the mold hole is used to compress the base powder filled into the die hole by a pressing machine from the top and the bottom to a punch to create the green compact 10 (see the upper half of FIG. 2). In this embodiment, as illustrated in FIG. 2, the groove parts 3 are formed in the green compact 10 during the machining step which is a post process. Therefore, the groove parts 3 are not formed in the green compact 10 during the molding step. Thus, the shape of the green compact 10 is such that it has no groove part.

The green compact 10 produced in the molding step has a cylindrical shape in which a shaft hole 2 is formed in the axial center, and has a shape corresponding to a sintered component 1 (see FIG. 1), except for the groove part 3. When molding the shaft hole 2 into the green compact 10 using a mold, a core rod is placed in the die hole to form the shaft hole 2. The height (axial length) of the green compact 10 to be molded depends on the application of the sintered component 1. However, in the case of a rotor for a vane pump, for example, it may be 6 mm or greater and 40 mm or less.

The internal side surface of the mold (such as the inner periphery of the die mold) may be coated with an external lubricant to prevent the metal powder from seizing the mold. Examples of external lubricants include fatty acid metal salts such as zinc stearate and lithium stearate, and fatty acid amides such as amide stearate and amide ethylene bistearate.

<Molding Condition>

The surface pressure at the time of compression molding is set to obtain the green compact 10 having a relative density of 88% or greater, and may be, for example, 600 MPa or greater, preferably 1000 MPa or greater, and further 1500 MPa or greater. A high surface pressure allows a high density of the green compact 10 and a high relative density of the green compact 10. The upper limit of the surface pressure is not particularly limited, but from a manufacturing viewpoint, for example, it may be 1200 MPa or less. The relative density of the green compact is preferably, for example, 92% or greater, and 93% or greater.

(Machining Step)

In the machining process, a groove part is machined into the green compact 10 before sintering (see a lower half in FIG. 2). The groove machining uses a cutting tool 40 as illustrated in FIG. 2 to form a groove part 3 on the outer peripheral surface of the green compact 10. In this embodiment, as illustrated in the lower half of FIG. 2, the rolling cutting tool 40 is moved along the axial direction of the green compact 10 to cut the green compact with a cutting blade 41 to form a groove part 3 communicating between the second surface 12 and the third surface 13 (from the upper end face to the lower end face of FIG. 2) of the green compact 10. The groove width of the groove part 3 to be formed shall be 1.0 mm or less, and preferably 0.7 mm or less. The lower limit of the groove width shall be 0.3 mm or greater, for example, regardless of the size. The depth of the groove part 3 to be formed shall be not less than 2 mm, and preferably not less than 3 mm. Here, the depth of the groove part 3 is the distance from the first surface 11 to the bottom surface 32.

Preferably, the ratio of the depth to the groove width (depth/groove width) of the groove part 3 is not less than 8. More preferably, 9 or greater is used. When the depth ratio of the groove part 3 to the groove width is increased, it is difficult to form the groove part 3 with a mold. However, in the groove part processing according to the present disclosure, the groove part 3 can be formed.

When a groove part 3 with a groove width of 0.5 mm and a depth of 5.0 mm is compressed with a mold, the mold for forming the groove part 3 was deformed when 20,000 pieces of molded products were made. When a groove part 3 with a groove width of 0.94 mm and a depth of 7.5 mm is compressed with a mold, the mold for forming the groove part 3 was deformed when 100,000 pieces of molded products were made. In the molding step of the present disclosure, even when 300,000 pieces of molded products are made, the mold is not deformed, and the groove part 3 can be processed without any problems in the subsequent processing process.

<Cutting Tool>

The cutting tool 40 forming the groove part 3 may be any suitable groove part cutting tool, including, for example, a milling cutter (see FIG. 3) with a cutting blade around the outer circumference. For example, carbide, high speed tool steel, cermet, and the like are used as materials for cutting tool 40.

Figure 3:
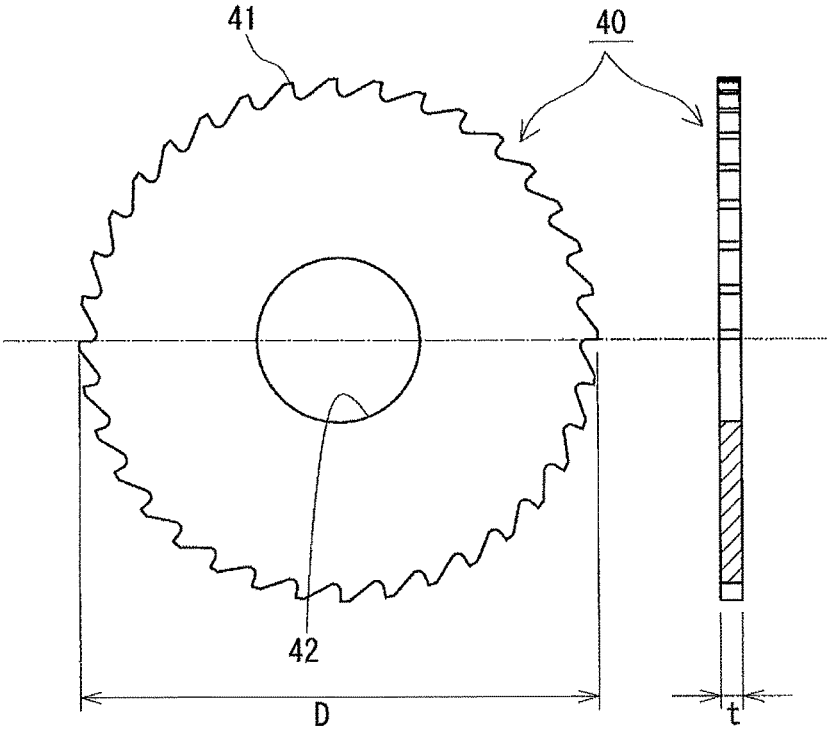
FIG. 3 schematically illustrates an example of a cutting tool used for processing a groove part in the process of manufacturing the sintered component according to an embodiment.

Referring to FIG. 3, a cutting tool 40 will be described. The cutting tool 40 illustrated in FIG. 3 is a disk-shaped milling tool (so-called metal saws) having a cutting blade 41 at its periphery. The cutting tool 40 has an outer diameter D of, for example, 20-300 mm. A boss hole 42 is provided at the center of the cutting tool 40, and a main shaft (not illustrated) of the machine is inserted into the boss hole 42, whereby the cutting tool 40 rotates as the main shaft rotates. When the cutting tool 40 performs the groove part processing, the groove width formed is determined by the thickness t of the cutting tool 40, and the thickness t is 1.0 mm or less, and preferably 0.7 mm or less. Further, in the cutting tool 40 illustrated in FIG. 3, the thickness t is substantially constant from the end of the cutting blade 41 toward the center, and both sides are flat. Specifically, the lateral escape gradient of the cutting blade 41 (the lateral angle to a radially parallel straight line through the outer periphery of the cutting blade 41) is not more than 0.15 degrees and not more than 0.12 degrees. In the case of the cutting tool 40 illustrated in FIG. 3, the outer diameter D is 50 mm, the thickness at the tip of the cutting blade 41 is 0.498 mm, the thickness of the portion located 9 mm inward from the tip of the cutting blade 41 is 0.467 mm, and the escape gradient of each side of the cutting blade 41 is 0.0987°. That is, the cutting tool 40 is a milling cutter with substantially no escape face on the side of the cutting blade 41.

When a cutting tool is used for groove part processing in the green compact, the particles of the metal powder constituting the green compact are cut by the cutting blade so as to be scraped off to form the groove part. When the green compact is grooved with a milling cutter having substantially no escape face on the side surface of the cutting blade as illustrated in FIG. 3, particles on the side surface of the cutting blade are pushed in by the side surface of the cutting blade because there is no clearance between the side surface of the cutting blade and the internal side surface of the groove part and there is no escape charge for particles falling from the internal side surface of the groove part. Therefore, it is possible to suppress the formation of the irregularities and irregularities by the particles on the internal side surface of the groove part, thereby smoothing the internal side surface and reducing the surface roughness of the internal side surface. In the present example, there is substantially no escape face on the side of the cutting blade, and the difference in thickness on one side of the cutting blade tip and the portion located inboard by the depth of the cutting blade from the blade of the cutting blade is smaller than the particle size of the metal powder, for example, ½ or less, ⅓ or less, or even ⅕ or less of the average particle size of the metal powder with respect to the centerline of the cutting tool thickness. On the other hand, if there is an escape face on the side of the cutting blade, a gap is formed between the side surface of the cutting blade and the internal side surface of the groove part at the position of the escape face, allowing for the escape of particles falling out from the internal side surface of the groove part, and the dropping of particles from the internal side surface may occur. Accordingly, the internal side surface of the groove part forms the irregularities caused by the particles, thereby increasing the surface roughness of the internal side surface.

When there is substantially no escape face on the side surface of the cutting blade, the surface roughness Ra (arithmetic average roughness) of the internal side surface of the groove part may be 5 μm or less and further 3 μm or less. Further, the surface roughness Rz (maximum height) of the internal side surface of the groove part may be smaller than the particle size of the metal powder constituting the green compact, for example, not more than ¼ of the average particle size of the metal powder, and in particular, not more than 25 μm and not more than 12.5 μm. On the other hand, when there is an escape face on the side surface of the cutting blade, for example, the surface roughness Ra of the internal side surface of the groove part is 8 μm or greater. In this case, the surface roughness Rz is equal to the particle size of the metal powder, for example, 50 μm or greater. The "arithmetic average roughness Ra" and "Maximum height Rz" are values measured in accordance with JIS B 0601-2001.

<Jig>

As illustrated in FIG. 2, the groove machining is preferably performed by holding the green compact 10 in the jig 50 from the viewpoint of machining accuracy and workability. The jig 50 illustrated in FIG. 2 is in a cylindrical shape and has a binding face 51 which is pressed against the end surface (lower end surface) from which the cutting tool 40 of the green compact 10 is drawn and a positioning mechanism 52 which positions the axial center of the green compact 10. In this example, the positioning mechanism 52 includes a shaft 521 which is passed through a shaft hole 2 of the green compact 10 and a nut 522 which secures the green compact 10 to the jig 50. The shaft 521 protrudes at one end side of the jig 50 perpendicular to the restraining surface 51 and is formed to correspond to the diameter of the shaft hole 2. The central axis of the jig 50 and the central axis of the shaft 521 are coaxial. When the green compact 10 is mounted to the jig 50, the lower end surface of the green compact 10 is directed toward the restraining surface 51 of the jig 50. After inserting the shaft 521 of the jig 50 into the shaft hole 2 of the green compact 10, the nut 522 is fastened to the shaft 521 to secure the green compact 10 to the jig 50. This allows the green compact 10 to be held in the jig 50 (shaft 521) and presses against the upper end surface of the green compact 10 with the nut 522 to press the lower end surface against the restraining surface 51. In addition, when the shaft 521 of the jig 50 is inserted into the shaft hole 2 of the green compact 10, the shaft center of the green compact 10 can be centered with respect to the jig 50 and positioned.

As illustrated in the lower half of FIG. 2, by performing groove machining while pressing the restraining surface 51 of the jig 50 against the end surface of the cutting tool 40, it is possible to effectively suppress the defect in the opening blade of the groove part 3 at the end surface on the side from which the cutting tool 40 is drawn out from occurring. Further, by the positioning mechanism 52 (the shaft 521 and the nut 522), the axial center of the green compact 10 is centered with respect to the jig 50 and positioned, so that the machining accuracy of the groove part 3 by the cutting tool 40 is improved. The positioning mechanism 52 may comprise, for example, a clamping portion or an in-line mechanism for grasping an outer peripheral surface (but not a groove part) of the green compact 10.

In this embodiment, the rotating cutting tool is moved along the axial direction of the green compact to form one groove part 3 on the outer peripheral surface of the green compact 10, and then the jig 50 is rotated to change the orientation of the green compact 10 so that the groove part 3 is formed sequentially at predetermined intervals. In this example, when groove machining is performed on the first compact 10, the cutting tool 40 cuts the green compact 10 through each jig 50. For example, it is possible to shorten the processing time by performing multiple groove machining on the green compact simultaneously with a plurality of cutting tools.

(Sintering Step)

In the sintering step, the green compact formed with the groove parts is sintered. By sintering the green compact, the particles of the metal powder come into contact with each other to obtain sintered component 1 (see FIG. 1). The sintering of the green compact is subject to known conditions depending on the composition of the metal powder. For example, in the case where the metal powder is an iron-based material, the sintering temperature may be, for example, 1100° C. or greater and 1400° C. or less, and 1200° C. or greater and 1300° C. or less. For example, the sintering time may be 15 minutes or more and 150 minutes or less, and 20 minutes or more and 60 minutes or less.

When the green compact is sintered, the volume shrinks or a phase transformation occurs due to sintering. Therefore, when the pre-sintering compact is compared with the sintered component, the relative density of the sintered component is slightly higher or the groove width of the groove part is slightly smaller. However, the difference is within the error range, and the relative density and the groove width of the groove part are substantially the same.

After the sintering step, various post-treatments, such as sizing, finishing, and heat treatment, may be performed as required.

<Sintered Component>

The sintered component according to the embodiment can be manufactured by the method of manufacturing the sintered component described above and is a sintered component 1 (see FIG. 1) having a groove part 3. The sintered component 1 has a first surface 11 having a groove part 3 formed thereon, a second surface 12 connected to the first surface 11, and a third surface 13 facing the second surface 12. The groove parts have two internal side surfaces 31 and a bottom surface 32 connected to the first surface. The groove parts 3 communicate with the second surface 12 to the third surface 13. The sintered component 1 of the embodiment has a relative density of 88% or greater and a groove width of 1.0 mm or less of the groove part 3.

(Relative Density)

Because the relative density of the sintered component 1 is 88% or greater, it has a high density and is rigid and has excellent durability. Preferably, the relative density is 90% or greater, and, more preferably, 93% or greater.

(Width of Groove Part)

Because the groove width of the groove part 3 is 1.0 mm or less, the groove width of the groove part 3 is narrow. If the sintered component 1 is a rotor for a vane pump, the width of the groove part 3 to which the vane is inserted is narrow so that the thickness of the vane used can be reduced. This reduces the sliding resistance between the tip of the vane, the inner peripheral surface of the cam ring, and the side surface of the vane, the plate material, the pump case, and the like, thereby reducing the pump loss. Preferably, the width of the groove part 3 is 0.7 mm or less. The lower limit of the groove width may be any particular but may be, for example, 0.3 mm or greater. Here, the groove width is the distance between two opposing internal side surfaces 31 at a position intersecting the base surface 32.

(Depth of Groove Part)

The depth of the groove part 3 is 2 mm or greater, so that the depth of the groove part 3 is deep. When the sintered component 1 is a rotor for a vane pump, the depth of the groove part 3 into which the vane is inserted increases the discharge rate of the pump. Preferably, the groove part 3 is at least 3 mm in depth. Here, the depth of the groove part 3 is the distance from the first surface 11 to the bottom surface 32.

(Angle Between the Internal Side Surface and the Bottom of the Groove Part)

The angle of the inner surface 31 relative to the plane perpendicular to the bottom surface 32 through the intersection line between the bottom surface 32 and the inner surface 31 is not more than 0.15° and not more than 0.12°. Here, the angle is in the direction of increasing the distance of the two internal side surfaces 31 from the base surface 32 toward the first surface 11.

(Surface Roughness of Internal Side Surface of Groove Part)

Further, it is preferable that the surface roughness of the internal side surface of the groove part 3 be 5 μm or less by the arithmetic average roughness Ra, and further 3 μm or less. The internal side surface is smooth because the surface roughness Ra of the internal side surface of the groove part 3 is 5 μm or less. Because the surface roughness of the internal side surface of the groove part 3 is small, in the case of a rotor for a vane pump, the sliding resistance of the vane inserted into the groove part 3 is reduced, and the vane is easily slidable. Further, there is a case where the surface roughness of the internal side surface of the groove part 3 is the maximum height Rz, for example, 25 μm or less, and further 12.5 μm or less. The surface roughness may be measured by cutting the sintered component 1 parallel to the groove part 3 so that the internal side surface of the groove part 3 is exposed.

(Length in Axial Direction)

The axial length (height) of the sintered component 1 may be, for example, 6 mm or greater. In the case of a rotor for a vane pump, because the axial length is 6 mm or greater, it is possible to increase the pump capacity and reduce the rotor diameter, thereby downsizing the pump. The upper limit of the axial length is not particularly limited, but is, for example, 40 mm or less.

Function and Effect

In the method of manufacturing a sintered component according to the above embodiment, because the pre-sintering green compact is grooved to form the groove part in the molding step, there is no conventional limitation on the core for forming the groove part in the molding step, and the surface pressure during compression molding can be increased. Therefore, it is possible to increase the density of the green compact by increasing the surface pressure, and easily make the green compact with a high density of 88% or greater. In addition, in the processing process, because the groove processing is performed on the green compact before sintering, a narrow groove part having a narrow groove width of 1.0 mm or less can be easily formed. Accordingly, the method of manufacturing the sintered component of the embodiment can form a groove part with a narrow groove width while the sintered component can be densified.

The sintered component in accordance with the embodiments described above have high density but narrow groove parts. Because the relative density of sintered component is 88% or greater and the density is high, it is rigid and durable. The groove width of the groove part is 1.0 mm or less, and the groove width of the groove part is small. The sintered component of the embodiment is suitable for use in, for example, a rotor for a vane pump.

Figure 4:
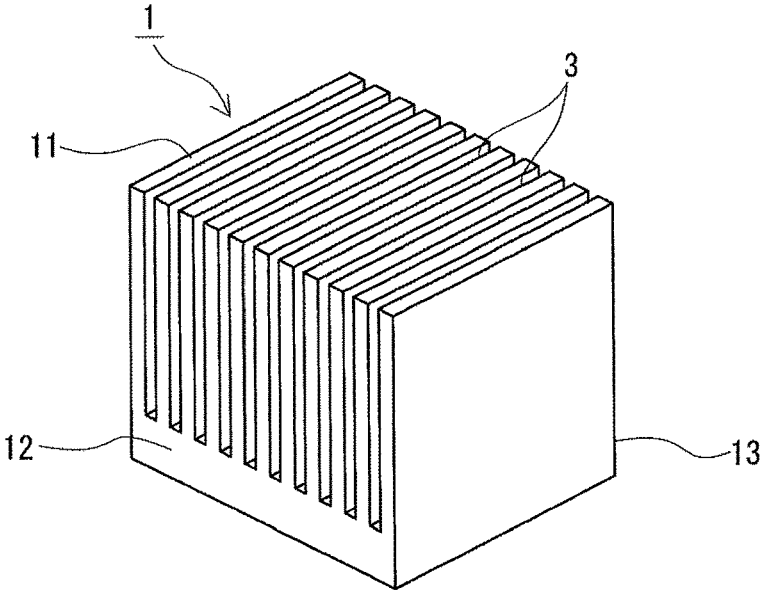
FIG. 4 is a schematic perspective view illustrating another example of the sintered component according to the embodiment.

In the above embodiment, a case where the sintered component is a rotor for a vane pump has been described. However, the present invention is not limited thereto, and the sintered component having a groove part can be used for various parts such as an automobile or an industrial machine. For example, a heat sink may be constructed in the sintered component 1 as illustrated in FIG. 4. In the case of a heat sink, because the groove width of the groove part 3 is small, the number of groove part 3 can be increased in relation to a unit area, thereby increasing the surface area and improving the heat dissipation performance of the heat sink. In the case of heat sinks, metal powders include aluminum-based or copper-based materials with high thermal conductivity.

EXPLANATION OF SYMBOLS

1 sintered component
10 green compact
11 first surface
12 second surface
13 third surface
2 shaft hole
3 groove part
31 internal side surface
32 base surface
40 cutting tool
41 cutting blade
42 boss hole
50 jig
51 binding face
52 positioning mechanism
521 shaft
522 nut

What is claimed is:

1. A sintered component having a relative density of 88% or greater, the sintered component comprising:
- a groove formed therein having a groove width of 1.0 mm or less,
- wherein a ratio obtained by dividing a groove depth of the groove by the groove width is greater than or equal to 8, and
- wherein an arithmetic average roughness Ra of an internal side surface of the groove is 5 μm or less.

2. The sintered component according to claim 1, wherein the sintered component is a rotor for a vane pump.

3. The sintered component according to claim 2, wherein a length of the sintered component in a direction of a rotation axis of the rotor is 6 mm or greater.

4. The sintered component according to claim 1, further comprising:
- a first surface having a cylindrical shape on which the groove is formed;
- a second surface contacting the first surface; and
- a third surface facing opposite to the second surface,
- wherein the groove communicates from the second surface to the third surface,
- wherein the groove has a base surface and two internal side surfaces,
- wherein the groove width of the groove is 0.3 mm or greater and 1.0 mm or smaller,
- wherein a surface roughness of the internal side surfaces is 5 μm or less by using an arithmetic average roughness Ra, and
- wherein an axial length of the sintered component is 6 mm or greater.

5. The sintered component according to claim 1, wherein the sintered component is an iron alloy comprising of not less than 88% mass of Fe, between 0.5% to 6.0% by total mass of at least one alloying element selected from Cu, Ni, Sn, Cr, and Mo, and between 0.2% to 2.0% by mass of C.

* * * * *